US010329736B2

(12) United States Patent
Nomura et al.

(10) Patent No.: US 10,329,736 B2
(45) Date of Patent: Jun. 25, 2019

(54) GRIP HEATER APPARATUS FOR CONSTRUCTION MACHINE

(71) Applicant: Hitachi Construction Machinery Tierra Co., Ltd., Koka-shi, Shiga (JP)

(72) Inventors: Takuya Nomura, Rittou (JP); Tatsuo Takishita, Koka (JP); Masayuki Yunoue, Koka (JP); Takeyuki Omiya, Rittou (JP); Wataru Takagi, Moriyama (JP)

(73) Assignee: Hitachi Construction Machinery Tierra Co., Ltd, Koka-shi (JP)

( * ) Notice: Subject to any disclaimer, the term of this patent is extended or adjusted under 35 U.S.C. 154(b) by 0 days.

(21) Appl. No.: 15/554,853

(22) PCT Filed: Feb. 23, 2016

(86) PCT No.: PCT/JP2016/055306
§ 371 (c)(1),
(2) Date: Aug. 31, 2017

(87) PCT Pub. No.: WO2017/047125
PCT Pub. Date: Mar. 23, 2017

(65) Prior Publication Data

US 2018/0038077 A1 Feb. 8, 2018

(30) Foreign Application Priority Data

Sep. 15, 2015 (JP) ..... 2015-182286

(51) Int. Cl.
*E02F 9/20* (2006.01)
*B62D 11/12* (2006.01)
(Continued)

(52) U.S. Cl.
CPC ..... *E02F 9/2004* (2013.01); *E02F 3/325* (2013.01); *E02F 3/964* (2013.01); *E02F 9/26* (2013.01); *G05G 1/06* (2013.01); *G05G 25/00* (2013.01)

(58) Field of Classification Search
CPC ..... G05G 1/06; B62D 11/001; B62D 11/12; B62J 33/00; B60R 1/00; E02F 9/26; E02F 9/20; H05B 1/02
See application file for complete search history.

(56) References Cited

U.S. PATENT DOCUMENTS 7,214,906 B1 * 5/2007 Hansen ..... B62J 33/00 219/204
2003/0226836 A1 12/2003 Miura et al.
2014/0173946 A1 * 6/2014 Gerrits ..... B62D 11/001 37/248

FOREIGN PATENT DOCUMENTS

DE 10 2012 210 473 A1 12/2013
EP 2 487 354 A2 8/2012
(Continued)

OTHER PUBLICATIONS

International Preliminary Report on Patentability (PCT/IB/338 & PCT/IB/373) issued in PCT Application No. PCT/JP2016/055306 dated Mar. 29, 2018, including English translation (Japanese-language Written Opinion (PCT/ISA/327) previously filed on Aug. 31, 2017) (six (6) pages).
(Continued)

*Primary Examiner* — Yuri Kan
(74) *Attorney, Agent, or Firm* — Crowell & Moring LLP

(57) ABSTRACT

Provided is a grip heater apparatus for a construction machine that can improve operability by heating the grip portions of left and right operating levers and maintaining a favorable operating environment for the left and right operating levers when work is carried out in a cold region and the
(Continued)

operator's hands get cold. The grip heater apparatus includes: left and right grip heaters 31 and 32 provided in grip portions of left and right operation levers 26 and 28, respectively; a battery supplying electric power to the left and right grip heaters; a heater switch 34 for instructing the left and right grip heaters to be turned on or off; and a control device supplying the electric power from the battery to the left and right grip heaters only when the engine is running, the gate lock lever 27 is at a getting-on/off prevention position, and the heater switch instructs the left and right grip heaters to be turned on.

4 Claims, 9 Drawing Sheets

(51) Int. Cl.

| | |
|---|---|
| ***H05B 1/02*** | (2006.01) |
| ***B62J 33/00*** | (2006.01) |
| ***E02F 9/26*** | (2006.01) |
| ***G05G 1/06*** | (2006.01) |
| ***E02F 3/32*** | (2006.01) |
| ***E02F 3/96*** | (2006.01) |
| ***G05G 25/00*** | (2006.01) |

(56) References Cited

FOREIGN PATENT DOCUMENTS

| | | | | | |
|---|---|---|---|---|---|
| JP | 59-83184 | U | | 6/1984 | |
| JP | 2001-41069 | A | | 2/2001 | |
| JP | 2004-9969 | A | | 1/2004 | |
| JP | 2004009969 | A | * | 1/2004 | ..... B62J 33/00 |
| JP | 2006-274788 | A | | 10/2006 | |
| JP | 2007-50785 | A | | 3/2007 | |
| JP | 2007-62506 | A | | 3/2007 | |
| JP | 2011-6936 | A | | 1/2011 | |
| JP | 2011006936 | A | * | 1/2011 | ..... E02F 9/26 |
| KR | 10-2004-0098371 | A | | 11/2004 | |
| WO | WO-2015163381 | A1 | * | 10/2015 | ..... B60R 1/00 |

OTHER PUBLICATIONS

International Search Report (PCT/ISA/210) issued in PCT Application No. PCT/JP2016/055306 dated May 17, 2016 with English translation (Four (4) pages).

Japanese-language Written Opinion (PCT/ISA/237) issued in PCT Application No. PCT/JP2016/055306 dated May 17, 2016 (Three (3) pages).

Korean-language Office Action issued in counterpart Korean Application No. 10-2017-7022696 dated Oct. 24, 2018 with English translation (10 pages).

Extended European Search Report issued in counterpart European Application No. 16845998.0 dated Mar. 22, 2019 (nine (9) pages).

* cited by examiner

GRIP HEATER APPARATUS FOR CONSTRUCTION MACHINE

TECHNICAL FIELD

The present invention relates to a construction machine such as a hydraulic excavator.

BACKGROUND ART

Generally, a construction machine such as a hydraulic excavator includes a self-propelled lower track structure, an upper swing structure provided in an upper portion of the lower track structure in such a manner as to be swingable, and a front work device provided in a front portion of the upper swing structure in such a manner as to be capable of being elevated.

Further, the upper swing structure substantially includes a swing frame that serves as a base, an operating room located on the left side of the front work device and provided on the swing frame, a counterweight provided in a rear end portion of the swing frame and maintaining a weight balance with the front work device, an engine mounted in the swing frame, and an exterior cover that covers mounted devices such as a hydraulic pump. An operator seat on which an operator is seated, left and right travel lever pedals for operating the lower track structure, left and right operation levers for operating the front work device, and the like are arranged in the operating room.

Types of the operating room of the construction machine are roughly classified into an open canopy type and a closed cab type. Patent Document 1, for example, discloses a construction machine with a canopy type operating room. Patent Document 2, for example, discloses a construction machine with a cab type operating room.

In a case of a hydraulic excavator equipped with the canopy type operating room, the operator seated on the operator seat operates the left and right operation levers while directly viewing the front work device and can carry out earth and sand excavation work or the like using the front work device. In a case of a hydraulic excavator equipped with the cab type operating room, the operator seated on the operator seat operates the left and right operation levers while viewing the front work device through a windshield on a front surface of the cab and can carry out earth and sand excavation work or the like using the front work device.

PRIOR ART DOCUMENTS

Patent Documents

Patent Document 1: JP-2007-62506-A
Patent Document 2: JP-2007-50785-A

SUMMARY OF THE INVENTION

Problem to be Solved by the Invention

However, in the case of the hydraulic excavator equipped with the canopy type operating room described in, for example, Patent Document 1, an interior of the operating room is exposed to outside air, with the result that operator's hands get cold and the operator finds it difficult to carry out fine operation at a time of work in a cold region.

On the other hand, in the case of the hydraulic excavator equipped with the cab type operating room described in, for example, Patent Document 2, it is unlikely that operator's hands get cold in a normal state since the cab closes off the interior of the operating room from outside air. However, when the operator carries out work in a state that a cab door is left open in order to secure, for example, a wide field of vision of surroundings of a machine body, the interior of the operating room is exposed to the outdoor air, the operator's hands get cold, and operability is affected similarly to the case of the canopy type.

The present invention has been achieved in the light of the problems described above, and an object thereof is to provide a grip heater apparatus for a construction machine that can improve operability by heating the grip portions of left and right operating levers and maintaining a favorable operating environment for the left and right operating levers when work is carried out in a cold region and the operator's hands get cold.

Means for Solving the Problems

To attain the object, the present invention provides a grip heater apparatus for a construction machine, the grip heater apparatus being provided in the construction machine that includes: a self-propelled lower track structure; an upper swing structure provided in an upper portion of the lower track structure in such a manner as to be swingable; a front work device provided in a front portion of the upper swing structure in such a manner as to be capable of being elevated; an engine mounted in the upper swing structure; a hydraulic pump driven by the engine; a plurality of hydraulic actuators driven by a hydraulic fluid supplied from the hydraulic pump, and driving the lower track structure, the front work device, and the upper swing structure; a plurality of directional control valves controlling flows of the hydraulic fluid supplied from the hydraulic pump to the respective plurality of hydraulic actuators; an operating room provided in the upper swing structure; left and right operation levers for operating the front work device; and a gate lock lever provided at an entrance of the operating room, and provided such that the gate lock lever can be operated to a getting-on/off permission position at which operation on the plurality of directional control valves is disabled and a getting-on/off prevention position at which the operation on the plurality of directional control valves is enabled, the grip heater apparatus controlling a temperature of a grip section of each of the left and right operation levers. The grip heater apparatus includes: left and right grip heaters provided in the grip portions of the left and right operation levers, respectively; a battery supplying electric power to the left and right grip heaters; a heater switch for instructing the left and right grip heaters to be turned on or off; and a control device supplying the electric power from the battery to the left and right grip heaters only when the engine is running, the gate lock lever is at the getting-on/off prevention position, and the heater switch instructs the left and right grip heaters to be turned on.

Advantages of the Invention

According to the present invention, it is possible to improve operability by heating the grip portions of left and right operating levers and maintaining a favorable operating environment for the left and right operating levers when work is carried out in a cold region and the operator's hands get cold.

MODES FOR CARRYING OUT THE INVENTION

Figure 1:
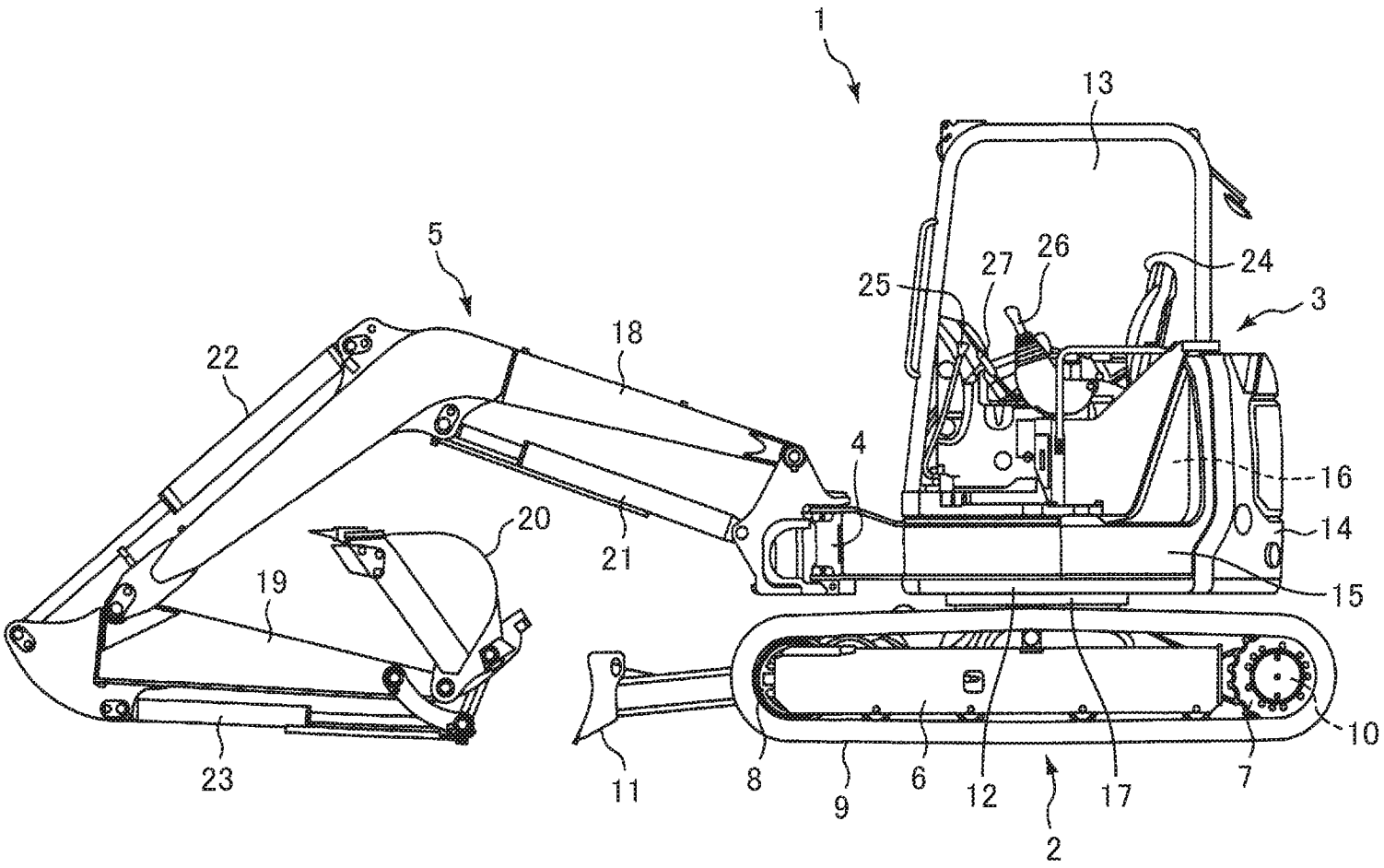
FIG. 1 is an external view of a hydraulic excavator that is equipped with a grip heater apparatus according to a first embodiment of the present invention.

Embodiments of the present invention will be described hereinafter with reference to the drawings. In the drawings, the same portions are denoted by the same reference characters and repetitive description is omitted as appropriate.

[First Embodiment]

FIG. 1 is an external view of a hydraulic excavator that is equipped with a grip heater apparatus according to a first embodiment of the present invention.

In FIG. 1, a hydraulic excavator 1 includes a self-propelled crawler-type lower track structure 2, an upper swing structure 3 provided in an upper portion of the lower track structure 2 in such a manner as to be swingable, a swing post 4 provided in a front portion of the upper swing structure 3 in such a manner as to be rotationally movable in left and right directions, and a multijoint-type front work device 5 coupled to the swing post 4 in such a manner as to be vertically and rotationally movable (to be capable of being elevated).

The lower track structure 2 includes a track frame 6 that is a substantially H-shape in a view from above, left and right driving wheels 7 (only the left side is shown) rotatably supported by vicinities of rear ends of left and right sides of the track frame 6, left and right driven wheels (idlers) 8 (only the left side is shown) rotatably supported by vicinities of front ends of left and right sides of the track frame 6, and left and right crawler belts (crawlers) 9 (only the left side is shown) wound around the left and right driving wheels 7 and driven wheels 8. The left and right driving wheels 7 are driven by left and right travelling hydraulic motors 10 (only the left side is shown), respectively.

A blade 11 for earth removal is provided on a front side of the track frame 6 in a vertically movable manner. By driving a blade hydraulic cylinder (not shown) to be expanded/contracted, the blade 11 vertically moves.

The upper swing structure 3 includes a swing frame 12 that serves as a base lower structure, a canopy type operating room 13 provided on the swing frame 12, a counterweight 14 provided in a rear end portion of the swing frame 12, and an exterior cover 15 covering most of portions on the swing frame 12 except for the operating room 13. Devices such as an engine and a hydraulic pump driven by the engine are accommodated in an engine room 16 defined by the exterior cover 15 between the operating room 13 and the counterweight 14.

A slewing ring 17 is provided in a central portion of the track frame 6 of the lower track structure 2, and the swing frame 12 of the upper swing structure 3 is provided swingably via the slewing ring 17. A swing hydraulic motor (not shown) drives the upper swing structure 3 to swing relatively to the lower track structure 2.

The swing post 4 is provided on a front side of the swing frame 12 of the upper swing structure 3 in such a manner as to be rotationally movable in left and right directions. By driving a swing hydraulic cylinder (not shown) to be expanded/contracted, the swing post 4 rotationally moves in left and right directions and the front work device 5 thereby rotationally moves in left and right directions.

The front work device 5 includes a boom 18 coupled to the swing post 4 in such a manner as to be vertically and rotationally movable, an arm 19 coupled to the boom 18 in such a manner as to be vertically and rotationally movable, and a bucket 20 coupled to the arm 19 in such a manner as to be vertically and rotationally movable. By driving a boom hydraulic cylinder 21, an arm hydraulic cylinder 22, and a bucket hydraulic cylinder 23 to be expanded/contracted, the boom 18, the arm 19, and the bucket 20 vertically and rotationally move.

An operator seat (seat) 24 on which an operator is seated is arranged in the operating room 13. Left and right travelling lever pedals 25 (only the left side is shown) capable of being operated by either hands or feet and instructing a motion of the left and right travelling hydraulic motors 10 (that is, the left and right crawler belts 9) by being operated forwardly and backwardly are arranged in front of the operator seat 24.

Figure 2:
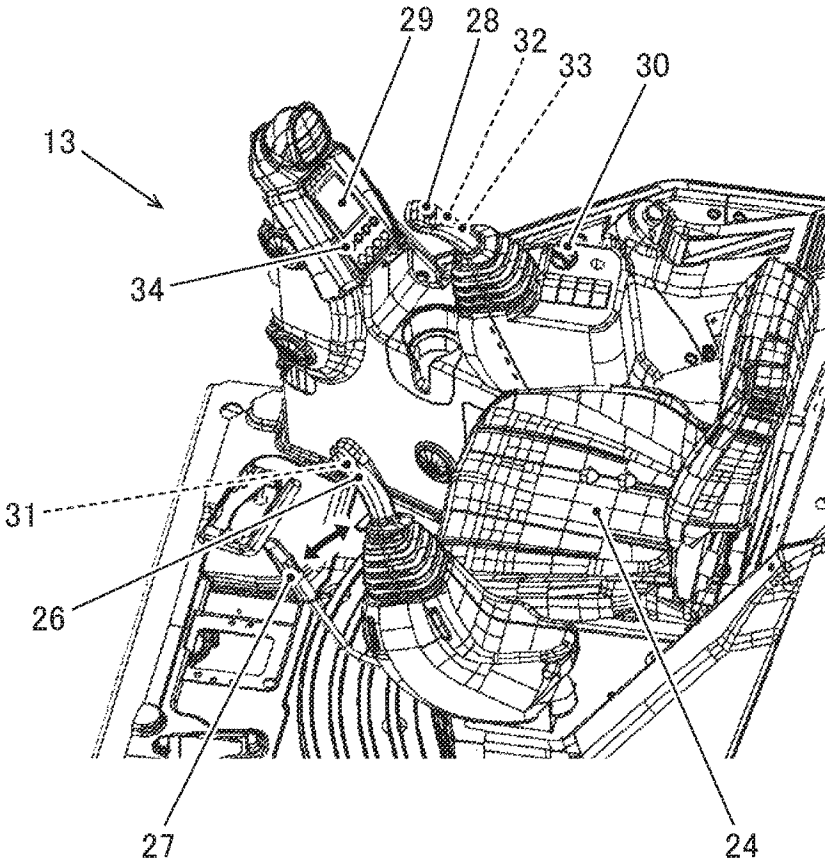
FIG. 2 is a perspective view of an operating room of the hydraulic excavator that is equipped with the grip heater apparatus according to the first embodiment of the present invention.

FIG. 2 is a perspective view of the operating room 13 of the hydraulic excavator 1.

In FIG. 2, a crisscross operating type arm/swing operation lever (left operation lever) 26 instructing a motion of the arm hydraulic cylinder 22 (that is, the arm 19) by being operated forwardly and backwardly, and instructing a motion of the swing hydraulic motor (that is, the upper swing structure 3) by being operated left and right directions is provided on the left side of the operator seat 24. A gate lock lever 27 capable of being operated to a down position (getting-on/off prevention position) for preventing the operator from getting on or off the hydraulic excavator 1 and to an up position (getting-on/off permission position) for permitting the operator to get on or off the hydraulic excavator 1 is provided in front of the left operation lever 26 (that is, at an entrance of the operating room 13).

A crisscross operating type boom/bucket operation lever (right operation lever) 28 instructing a motion of the boom hydraulic cylinder 21 (that is, the boom 18) by being operated forwardly and backwardly and instructing a motion of the bucket hydraulic cylinder 23 (that is, the bucket 20) by being operated left and right directions, and a blade operation lever (not shown) instructing a motion of the blade hydraulic cylinder (that is, the blade 11) by being operated forwardly and backwardly are arranged on the right side of the operator seat 24. A display device 29 displaying various information about the hydraulic excavator 1 in response to operator's operation is provided in front of the right operation lever 28. A key switch 30 instructing start/stop of the engine, a dial (not shown) instructing a target revolution speed of the engine, and the like are arranged in rear of the right operation lever 28.

Figure 3:
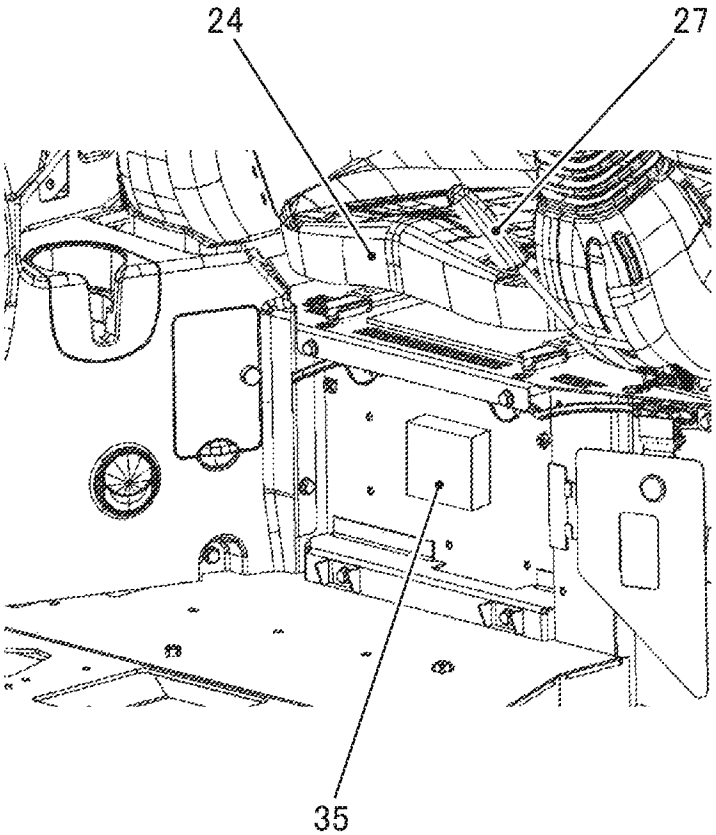
FIG. 3 is a perspective view illustrating a lower space of an operator seat of the hydraulic excavator that is equipped with the grip heater apparatus according to the first embodiment of the present invention.

Left and right grip heaters 31 and 32 each having a heater line or a flexible heat transfer substrate are contained in grip portions of the left and right operation levers 26 and 28, respectively, and a temperature sensor 33 is contained in the grip section of any one of the left and right operation levers 26 and 28 (the right operation lever 28 in the present embodiment). An alternate heater switch 34 for instructing the left and right grip heaters 31 and 32 to be turned ON/OFF is arranged in an operation section of the display device 29. As shown in FIG. 3, the left and right grip heaters 31 and 32 are controlled by a controller 35 arranged in a lower space of the operator seat 24. A function of the controller 35 will be described later.

Figure 4:
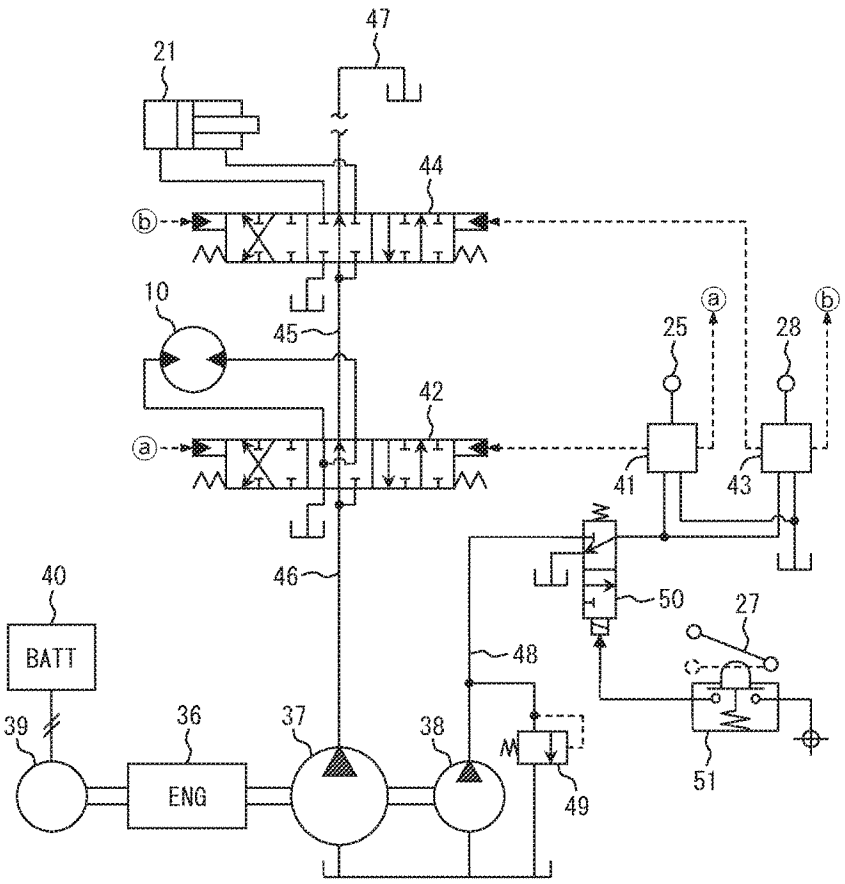
FIG. 4 is a configuration diagram of a hydraulic drive system mounted in the hydraulic excavator that is equipped with the grip heater apparatus according to the first embodiment of the present invention.

FIG. 4 is a configuration diagram of a hydraulic drive system mounted in the hydraulic excavator 1. For the sake of simplification of description, FIG. 4 illustrates only configurations related to driving of the left travelling hydraulic motor 10 and the boom hydraulic cylinder 21 and does not illustrate configurations related only to driving of the right travelling hydraulic motor, the arm hydraulic cylinder 22, the bucket hydraulic cylinder 23, the turning hydraulic motor, the swing hydraulic cylinder, and the blade hydraulic cylinder.

In FIG. 4, the hydraulic drive system includes an engine 36, a hydraulic pump 37 and a pilot pump 38 each driven by the engine 36 and delivering a hydraulic fluid, an alternator 39 driven by the engine 36 and generating electric power, a battery 40 charged with electric power by the alternator 39 and supplying the electric power to electric components such as the left and right grip heaters 31 and 32, a hydraulic pilot type operating device 41 including the left travelling lever pedal 25, a left travelling directional control valve 42 controlling a flow of the hydraulic fluid from the hydraulic pump 37 to the left travelling hydraulic motor 10 in response to a forward or backward operation on the left travelling lever pedal 25, a hydraulic pilot type operating device 43 including the boom/bucket operation lever 28, and a boom directional control valve 44 controlling a flow of the hydraulic fluid from the hydraulic pump 37 to the boom hydraulic cylinder 21 in response to a forward or backward operation on the boom/bucket operation lever 28.

The left travelling directional control valve 42, the boom directional control valve 44, and other directional control valves (which specifically include a right travelling directional control valve, an arm directional control valve, a bucket directional control valve, a turning directional control valve, a swing directional control valve, and a blade directional control valve that are not shown) are of center bypass type, and each include a center bypass passage located on a center bypass line 45. The center bypass passage of each directional control valve, which is connected to the center bypass line 45 in series, opens the center bypass line 45 when a spool of each directional control valve is at a neutral position, and interrupts the center bypass line 45 when the spool is switched to a left or right switching position in FIG. 4. An upstream side of the center bypass line 45 is connected to a delivery line 46 of the hydraulic pump 37, and a downstream side of the center bypass line 45 is connected to a tank line 47.

The left travelling directional control valve 42 is switched by a pilot pressure outputted from the operating device 41. The operating device 41 includes the left travelling lever pedal 25 and a pair of pilot valves (not shown) each generating a pilot pressure in response to a forward or backward operation on the left travelling lever pedal 25 using a delivery pressure of the pilot pump 38 as an original pressure. When the left travelling lever pedal 25 is operated forward from a neutral position, the pilot pressure generated by one of the pilot valves acts on a pressure receiving section, which is on the right side in FIG. 4, of the left travelling directional control valve 42 in response to an operation amount, and the left travelling directional control valve 42 is switched to the switching position on the right side in FIG. 4. The left travelling hydraulic motor 10 thereby rotates in a forward direction to drive the left driving wheel 7 and the crawler belt 9 forward. On the other hand, when the left travelling lever pedal 25 is operated backward from the neutral position, the pilot pressure generated by the other pilot valve acts on a pressure receiving section, which is on the left side in FIG. 4, of the left travelling directional control valve 42 in response to an operation amount, and the left travelling directional control valve 42 is switched to the switching position on the left side in FIG. 4. The left travelling hydraulic motor 10 thereby rotates in a backward direction to drive the left driving wheel 7 and the crawler belt 9 backward.

The boom directional control valve 44 is switched by a pilot pressure outputted from the operating device 43. The operating device 43 includes the boom/bucket operation lever 28 and a pair of pilot valves (not shown) each generating a pilot pressure in response to a forward or backward operation on the operation lever 28 using the delivery pressure of the pilot pump 38 as the original pressure. When the operation lever 28 is operated forward from a neutral position, the pilot pressure generated by one of the pilot valves acts on a pressure receiving section, which is on the right side in FIG. 4, of the boom directional control valve 44 in response to an operation amount, and the boom directional control valve 44 is switched to the switching position on the right side in FIG. 4. The boom hydraulic cylinder 21 is thereby contracted to move down the boom 18. On the other hand, when the operation lever 28 is operated backward from the neutral position, the pilot pressure generated by the other pilot valve acts on a pressure receiving section, which is on the left side in FIG. 4, of the boom directional control valve 44 in response to an operation amount, and the boom directional control valve 44 is switched to the switching position on the left side in FIG. 4. The boom hydraulic cylinder 21 is thereby expanded to move up the boom 18.

A pilot relief valve 49 is provided in a delivery line 48 of the pilot pump 38 for keeping the delivery pressure of the pilot pump 38 constant. A lock valve 50 is also provided in the delivery line 48 of the pilot pump 38 and the lock valve 50 is switched in response to operation on the gate lock lever 27. Specifically, when the gate lock lever 27 is operated to the down position, a lock switch 51 is closed to carry a current to a solenoid drive section of the lock valve 50, and the lock valve 50 is switched to a communication position which is on the lower side in FIG. 4. The original pressure is thereby supplied from the pilot pump 38 to the operating devices 41, 43, and the like, and the operating devices 41, 43, and the like are capable of operating the directional control valves 42, 44, and the like. On the other hand, when the gate lock lever 27 is operated to the up position, the lock switch 51 is opened to stop carrying the current to the solenoid drive section of the lock valve 50, and the lock valve 50 is switched to a neutral position, which is on the upper side in FIG. 4, by a force of a spring. Supply of the original pressure from the pilot pump 38 to the operating devices 41, 43, and the like is thereby interrupted, and the operating devices 41, 43, and the like are incapable of operating the directional control valves 42, 44, and the like.

Figure 5:
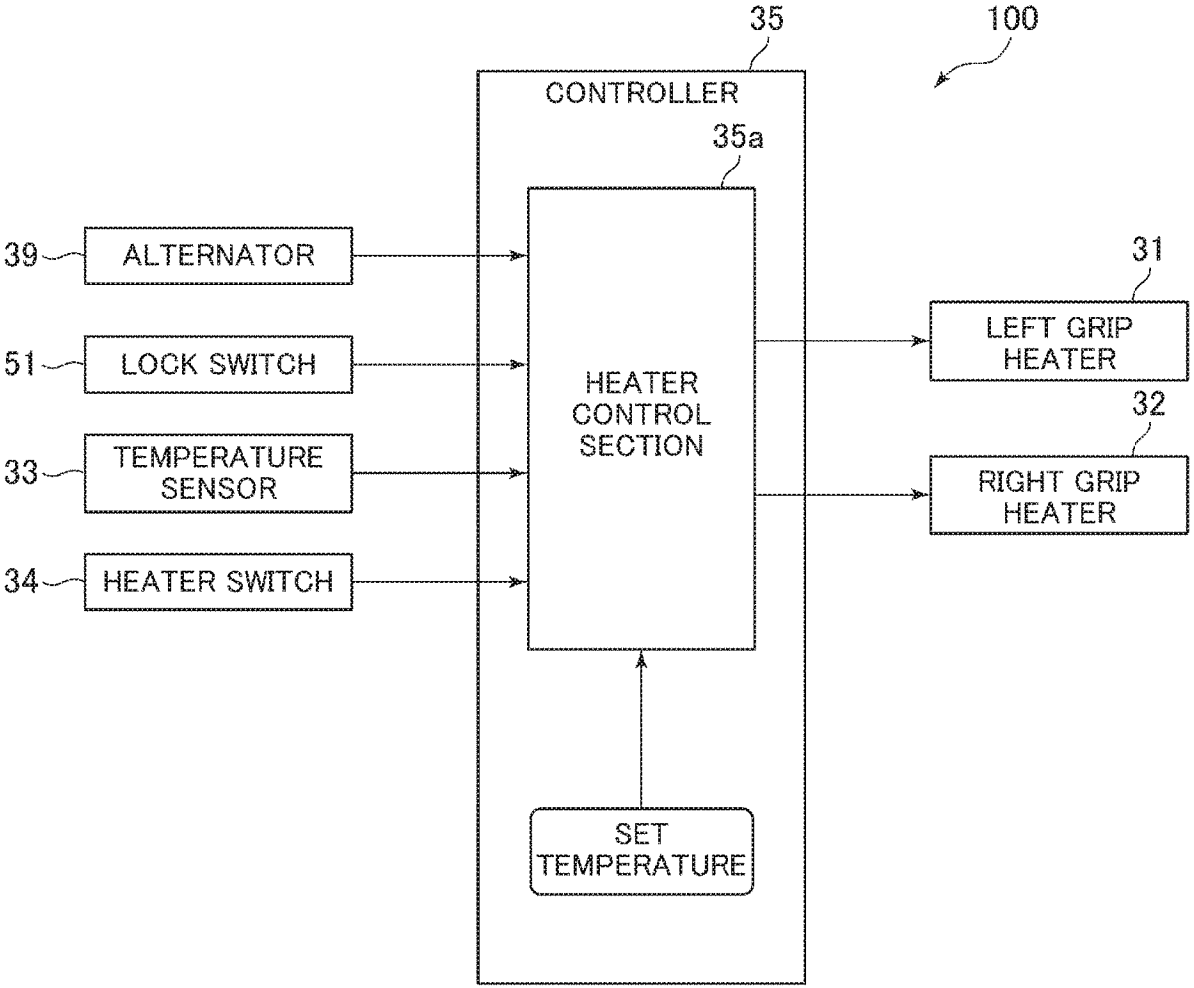
FIG. 5 is a functional block diagram of the grip heater apparatus according to the first embodiment of the present invention.

FIG. 5 is a functional block diagram of the grip heater apparatus.

In FIG. 5, a grip heater apparatus 100 includes the controller 35, the alternator 39, the lock switch 51, the temperature sensor 33, the heater switch 34, and the left and right grip heaters 31 and 32.

The controller 35 includes a heater control section 35*a* that controls the left and right grip heaters 31 and 32 on the basis of input signals from the alternator 39, the lock switch 51, the temperature sensor 33, and the heater switch 34 and a predetermined set temperature.

Figure 6A:
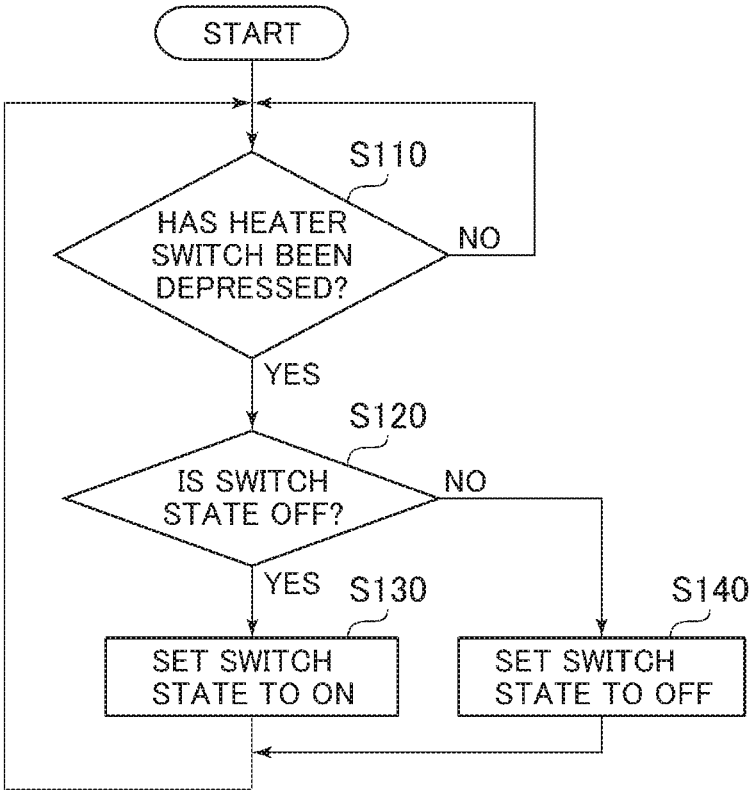
FIG. 6A is a flowchart illustrating a process by a heater control section of a controller provided in the grip heater apparatus according to the first embodiment of the present invention.
Figure 6B:
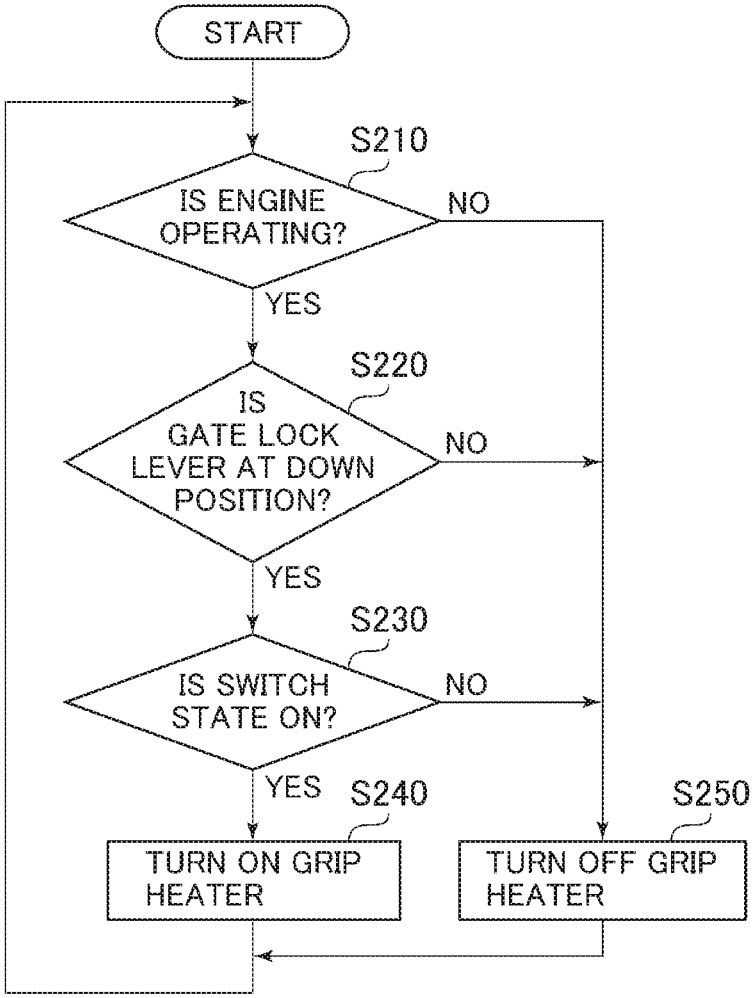
FIG. 6B is a flowchart illustrating a process by the heater control section of the controller provided in the grip heater apparatus according to the first embodiment of the present invention.

FIGS. 6A and 6B are flowcharts illustrating processes by the heater control section 35*a*. A flow shown in FIG. 6A is a flow for monitoring ON/OFF states of the heater switch 34, while a flow shown in FIG. 6B is a flow for controlling the grip heaters 31 and 32. The heater control section 35*a* executes the two flows shown in FIGS. 6A and 6B in parallel. The flows will be described below in sequence.

In the flow of FIG. 6A, the heater control section 35*a* first judges whether the heater switch 34 on the display device 29 has been depressed (Step S110).

When it is judged in Step S110 that the heater switch 34 has not been depressed (NO), the heater control section 35*a* returns to Step S110.

On the other hand, when determining in Step S110 that the heater switch 34 has been depressed (YES), the heater control section 35*a* determines whether a switch state flag is OFF (Step S120). It is noted here that the switch state flag is a flag that indicates which state, ON or OFF, the alternate heater switch 34 is in and is stored in a memory (not shown) of the controller 35.

When it is judged in Step S120 that the switch state flag is OFF (YES), the heater control section 35*a* sets the switch state flag to ON (Step S130), and returns to Step S110.

On the other hand, when it is judged in Step S120 that the switch state flag is ON (NO), the heater control section 35*a* sets the switch state flag to OFF (Step S140), and returns to Step S110.

In the flow of FIG. 6B, the heater control section 35*a* first judges whether the engine 36 is running on the basis of the signal from the alternator 39 (Step S210).

When it is judged in Step S210 that the engine 36 is running (YES), the heater control section 35*a* judges whether the gate lock lever 27 is at the down position on the basis of the signal from the lock switch 51 (Step S220).

When it is judged in Step S220 that the gate lock lever 27 is at the down position (YES), the heater control section 35*a* determines whether the switch state flag is ON (Step S230).

When it is judged in Step S230 that the switch state flag is ON (YES), the heater control section 35*a* turns on the left and right grip heaters 31 and 32 and adjusts the electric power supplied to the left and right grip heaters 31 and 32 in such a manner as to reduce a difference between a temperature of the grip section of the right operation lever 28 detected by the temperature sensor 33 and the predetermined set temperature (Step S240), and returns to Step S210.

On the other hand, when it is judged NO in any one of Steps S210, S220 and S230, the heater control section 35*a* turns off the left and right grip heaters 31 and 32 (Step S250), and returns to Step S210.

The grip heater apparatus 100 according to the present embodiment configured as described above improve operability by heating the grip portions of left and right operating levers 26 and 28 and maintaining a favorable operating environment for the left and right operating levers 26 and 28 when work is carried out in a cold region and the operator's hands get cold.

Furthermore, when the engine 36 is stopped or when the gate lock lever 27 is at the getting-on/off permission position (that is, when the operation on the left and right operation levers 26 and 28 is disabled), the supply of the electric power from the battery 40 to the left and right grip heaters 31 and 32 is stopped whether the heater switch 34 is turned on or off. It is thereby possible to prevent unnecessary power consumption due to, for example, an omission to turn off the heater switch 34 when the operator temporarily gets off the hydraulic excavator 1.

[Second Embodiment]

A grip heater apparatus according to a second embodiment of the present invention will be described while centering on differences from the first embodiment. The grip heater apparatus according to the present embodiment is configured such that a temperature adjustment function for the left and right grip heaters 31 and 32 is added to the grip heater apparatus 100 (refer to FIG. 5) according to the first embodiment.

Figure 7:
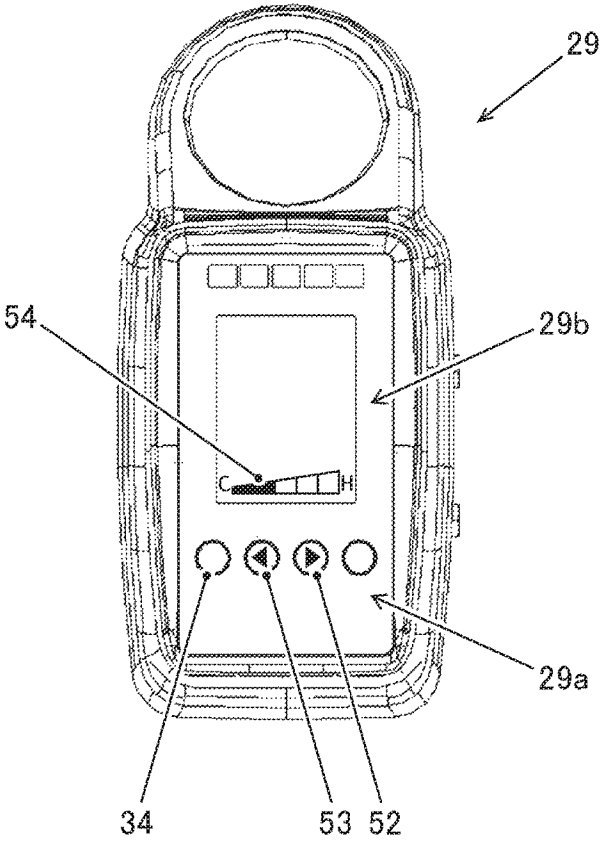
FIG. 7 is a front view of a display device arranged in an operating room of the hydraulic excavator that is equipped with a grip heater apparatus according to a second embodiment of the present invention.

FIG. 7 is a front view of the display device 29 provided at the operator seat 24 of the hydraulic excavator 1.

In FIG. 7, not only the heater switch 34 but also an alternate temperature increase switch 52 for instructing the temperatures of the left and right grip heaters 31 and 32 to be increased and an alternate temperature decrease switch 53 for instructing the temperatures of the left and right grip heaters 31 and 32 to be decreased are provided in an operation section 29*a* of the display device 29. Furthermore, a set temperature indicator 54 for displaying a set temperature of the left and right grip heaters 31 and 32 is provided in a display section 29*b* of the display device 29.

Figure 8:
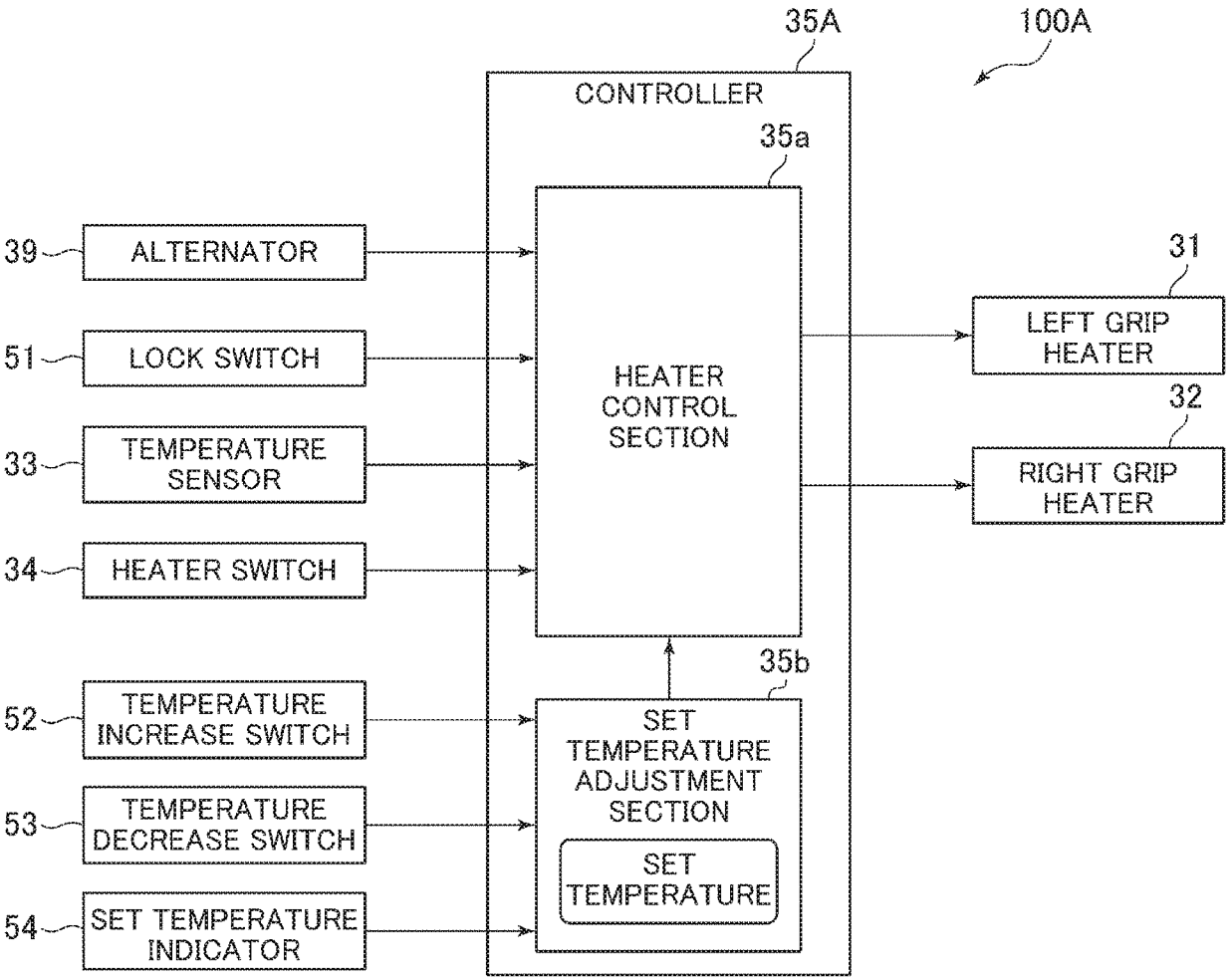
FIG. 8 is a functional block diagram of the grip heater apparatus according to the second embodiment of the present invention.

FIG. 8 is a functional block diagram of the grip heater apparatus according to the present embodiment.

In FIG. 8, a grip heater apparatus 100A includes a controller 35A as an alternative to the controller 35 (refer to FIG. 5) according to the first embodiment, and further includes the temperature increase switch 52, the temperature decrease switch 53, and the set temperature indicator 54.

In FIG. 8, the controller 35A includes a heater temperature setting section 35*b* in addition to the heater control section 35*a* (refer to FIG. 5) according to the first embodiment.

When the temperature increase switch 52 is depressed, the heater temperature setting section 35*b* increases the set temperature of the left and right grip heaters 31 and 32 stepwise, and lengthens the lit-up portion of the set temperature indicator 54 of the display section 29*b* stepwise. When the temperature increase switch 52 is depressed, the heater temperature setting section 35*b* decreases the set temperature of the left and right grip heaters 31 and 32 stepwise, and shortens the lit-up portion of the set temperature indicator 54 of the display section 29*b* stepwise.

The grip heater apparatus 100A according to the present embodiment configured as described above can attain similar effects to those of the first embodiment. Furthermore, by providing the temperature increase switch 52, the temperature decrease switch 53, and the set temperature indicator 54, it is possible to adjust the temperatures of the left and right grip heaters 31 and 32 depending on an operating condition of the left and right operation levers 26 and 28 (such as whether the left and right operation levers 26 and 28 are operated with bare hands or with work gloved hands) and an operating environment (such as an outside air temperature).

While the grip heater apparatus 100 or 100A according to the embodiments described above is applied to the hydraulic excavator 1 equipped with the canopy type operating room 13, the present invention is not limited to this application and is also applicable to a hydraulic excavator equipped with a cab type operating room. In that case, the grip heater apparatus 100 or 100A can improve operability by heating the grip portions of left and right operating levers 26 and 28 with the left and right grip heaters 31 and 32 turned on and maintaining a favorable operating environment for the left and right operating levers when work is carried out in a cold region with the cab door left open in order to secure, for example, a wide field of vision of surroundings of a machine body.

Moreover, the present invention is not limited to the embodiments described above and encompasses various modifications. For example, although the abovementioned embodiments have been described in detail for describing the present invention so that the present invention is easy to understand, the present invention is not necessarily limited to the embodiments having all the configurations described above. Moreover, the configuration of an embodiment can be partially replaced by the configuration of another embodiment or the configuration of an embodiment can be added to the configuration of another embodiment. Furthermore, for a part of the configuration of each embodiment, addition, deletion, or replacement of the other configuration can be made.

DESCRIPTION OF REFERENCE CHARACTERS

1: Hydraulic excavator (construction machine)
2: Lower track structure
3: Upper swing structure
4: Swing post
5: Front work device
6: Track frame
7: Driving wheel
8: Driven wheel
9: Crawler belt
10: Left travelling hydraulic motor (hydraulic actuator)
11: Blade
12: Swing frame
13: Operating room
14: Counterweight
15: Exterior cover
16: Engine room
17: Slewing ring
18: Boom
19: Arm
20: Bucket
21: Boom hydraulic cylinder (hydraulic actuator)
22: Arm hydraulic cylinder (hydraulic actuator)
23: Bucket hydraulic cylinder (hydraulic actuator)
24: Operator seat
25: Left travelling lever pedal
26: Arm/swing operation lever (left operation lever)
27: Gate lock lever
28: Boom/bucket operation lever (right operation lever)
29: Display device
29*a*: Operation section
29*b*: Display section
30: Key switch
31: Left grip heater
32: Right grip heater
33: Temperature sensor
34: Heater switch
35, 35A: Controller (control device)
35*a*: Heater control section
35*b*: Heater temperature setting section
36: Engine
37: Hydraulic pump
38: Pilot pump
39: Alternator
40: Battery
41: Operating device
42: Left travelling directional control valve
43: Operating device
44: Boom directional control valve
45: Center bypass line
46: Hydraulic pump delivery line
47: Tank line
48: Pilot pump delivery line
49: Pilot relief valve
50: Lock valve
51: Lock switch
52: Temperature increase switch
53: Temperature decrease switch
54: Set temperature indicator
100, 100A: Grip heater apparatus

The invention claimed is:

1. A construction machine, comprising:

a self-propelled lower track structure;

an upper swing structure provided in an upper portion of the lower track structure in such a manner as to be swingable;

a front work device provided in a front portion of the upper swing structure in such a manner as to be capable of being elevated;

an engine mounted in the upper swing structure;

a hydraulic pump driven by the engine;

a plurality of hydraulic actuators driven by a hydraulic fluid supplied from the hydraulic pump, and driving the lower track structure, the front work device, and the upper swing structure;

a plurality of directional control valves controlling flows of the hydraulic fluid supplied from the hydraulic pump to the plurality of hydraulic actuators;

an operating room provided in the upper swing structure;

left and right operation levers for operating the front work device;

a gate lock lever provided at an entrance of the operating room, and provided such that the gate lock lever can be operated to a getting-on/off permission position at which operation on the plurality of directional control valves is disabled and a getting-on/off prevention position at which the operation on the plurality of directional control valves is enabled; and a grip heater apparatus controlling a temperature of a grip section of each of the left and right operation levers, wherein the grip heater apparatus comprises:

left and right grip heaters provided in grip portions of the left and right operation levers, respectively;

a battery supplying electric power to the left and right grip heaters;

a heater switch for instructing the left and right grip heaters to be turned on or off; and a controller controlling the left and right grip heaters, and the controller is configured to control the battery to supply the electric power to the left and right grip heaters only when the engine is running, the gate lock lever is at the getting-on/off prevention position, and the heater switch instructs the left and right grip heaters to be turned on.

2. The construction machine according to claim 1, wherein:

the grip heater apparatus further comprises a temperature sensor provided in the grip section of any one of the left and right operation levers, and the controller is configured to adjust the electric power supplied to the left and right grip heaters in such a manner as to reduce a difference between a temperature detected by the temperature sensor and a predetermined set temperature.

3. The construction machine according to claim 2, wherein:

the grip heater apparatus further comprises: a temperature increase switch instructing temperatures of the left and right grip heaters to be increased; and a temperature decrease switch instructing the temperatures of the left and right grip heaters to be decreased, and the controller is configured to increase the predetermined set temperature when the temperature increase switch is depressed, and decrease the predetermined set temperature when the temperature decrease switch is depressed.

4. The construction machine according to claim 3, further comprising:

a display device provided in the operating room, wherein the controller is configured to display the predetermined set temperature on the display device.

* * * * *